US009033147B2

(12) United States Patent
Lee

(10) Patent No.: US 9,033,147 B2
(45) Date of Patent: May 19, 2015

(54) HOLDER FOR PORTABLE ELECTRONIC DEVICE

(71) Applicant: Chi Mei Communication Systems, Inc., New Taipei (TW)

(72) Inventor: Chueh Lee, New Taipei (TW)

(73) Assignee: Chi Mei Communication Systems, Inc., New Taipei (TW)

( * ) Notice: Subject to any disclaimer, the term of this patent is extended or adjusted under 35 U.S.C. 154(b) by 27 days.

(21) Appl. No.: 13/862,876

(22) Filed: Apr. 15, 2013

(65) Prior Publication Data

US 2013/0284615 A1 Oct. 31, 2013

(30) Foreign Application Priority Data

Apr. 27, 2012 (TW) ..... 101208014 U

(51) Int. Cl.
*A45C 11/00* (2006.01)
*B65D 81/36* (2006.01)

(52) U.S. Cl.
CPC ..... *A45C 11/00* (2013.01); *A45C 2011/003* (2013.01); *A45C 2200/15* (2013.01)

(58) Field of Classification Search
CPC ..... A45C 2011/003; A45C 2013/025; A45C 11/00
USPC ..... 206/45.23, 45.2, 45.24, 751, 763, 320; 248/460, 459; 361/679.55, 679.56; D14/440
See application file for complete search history.

(56) References Cited

U.S. PATENT DOCUMENTS

| | | | | |
|---|---|---|---|---|
| 7,545,634 | B2 | 6/2009 | Simonian et al. | |
| D639,296 | S | 6/2011 | Tseng et al. | |
| D673,157 | S | 12/2012 | Lu et al. | |
| D673,158 | S | 12/2012 | Yang et al. | |
| D674,396 | S | 1/2013 | Yang et al. | |
| D674,802 | S | 1/2013 | Lu et al. | |
| 8,393,464 | B2 | 3/2013 | Yang et al. | |
| D679,279 | S | 4/2013 | Yang et al. | |
| 2011/0163642 | A1 | 7/2011 | Rohrbach et al. | |
| 2011/0266194 | A1 | 11/2011 | Bau | |
| 2012/0146466 | A1 | 6/2012 | Lu et al. | |
| 2012/0211613 | A1* | 8/2012 | Yang et al. | 248/174 |
| 2012/0211631 | A1* | 8/2012 | Lu et al. | 248/371 |

FOREIGN PATENT DOCUMENTS

WO 2010/036090 A1 4/2010

* cited by examiner

*Primary Examiner* — Mickey Yu
*Assistant Examiner* — Allan Stevens
(74) *Attorney, Agent, or Firm* — Novak Druce Connolly Bove + Quigg LLP

(57) ABSTRACT

A holder is for supporting a portable electronic device, including at least one sheet. A base portion, a first supporting portion and a second supporting portion formed on the at least one sheet. The base portion, the first supporting portion and the second supporting portion are parallel with each other and folded relative to each other. A latching piece is formed on the base portion, the latching piece having a bendable portion. The first supporting portion is folded relative to the base portion, and the second supporting portion is folded relative to the first supporting portion until the second supporting portion is held by the latching piece, the base portion, the first supporting portion and the second supporting portion cooperatively form a three-dimensional structure that can support the portable electronic device at an angle relative to the at least one sheet without collapsing.

11 Claims, 8 Drawing Sheets

HOLDER FOR PORTABLE ELECTRONIC DEVICE

CROSS-REFERENCE TO RELATED APPLICATIONS

This application is related to co-pending U.S. patent application Ser. Nos. 13/862,890, 13/862,895 and 13/862,885, all entitled "HOLDER FOR PORTABLE ELECTRONIC DEVICE", and all invented by CHUEH LEE. All these related applications have the same assignee as the present application and have been concurrently filed herewith. The above-identified applications are incorporated herein by reference.

BACKGROUND

Technical Field

This disclosure relates to holders for portable electronic devices, particularly, to a multifunction holder for protecting and supporting portable electronic devices.

Holders are widely used to protect portable electronic devices and support the portable electronic device for a user to, for example, read an eBook or watch video. However, it can be difficult to carry the holder and the electronic device at the same time.

Therefore, there is room for improvement within the art.

BRIEF DESCRIPTION OF THE DRAWINGS

Many aspects of the holder can be better understood with reference to the following drawings. The components in the drawings are not necessarily drawn to scale, the emphasis instead being placed upon clearly illustrating the principles of the holder.

DETAILED DESCRIPTION

Figure 1:
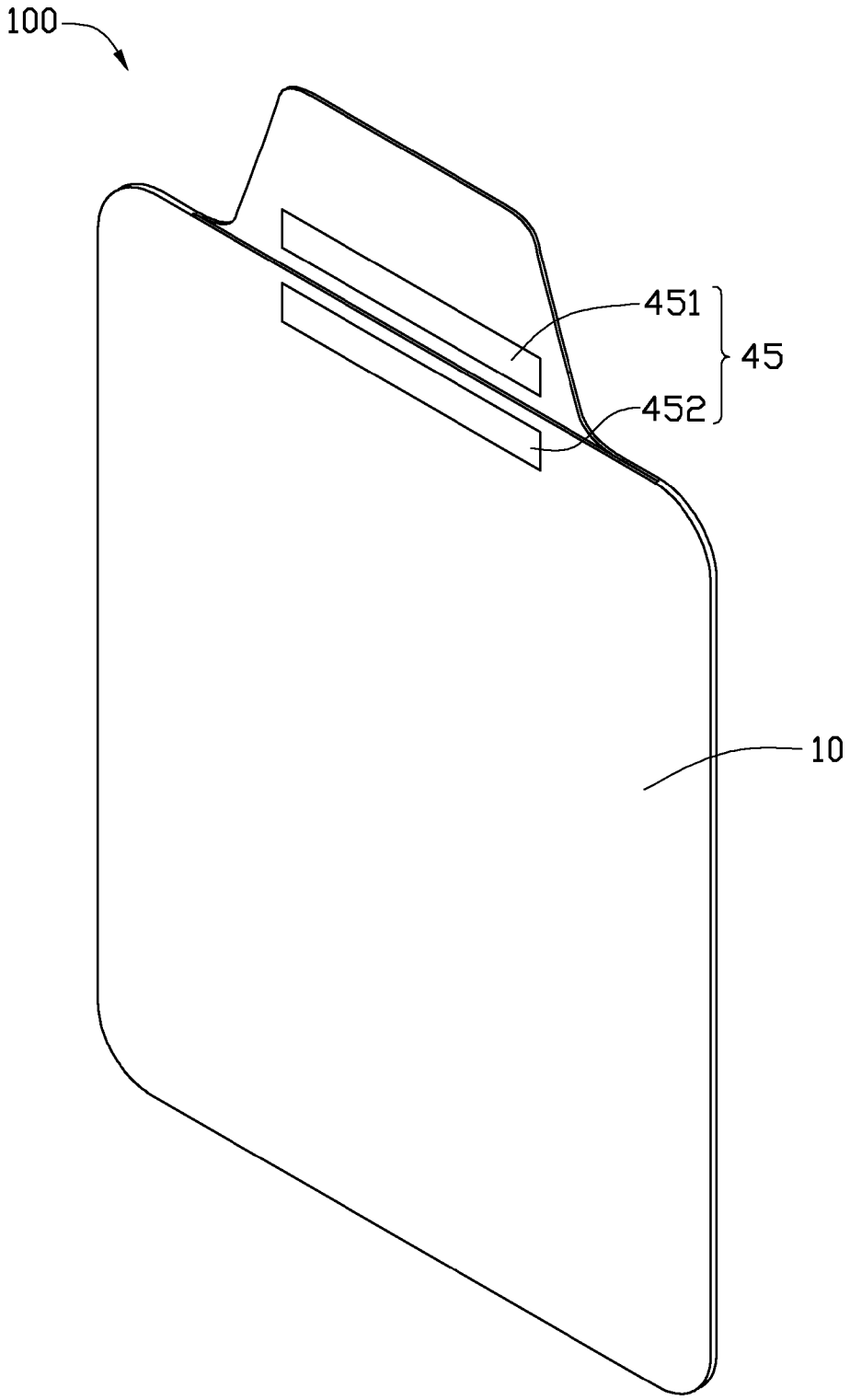
FIG. 1 is an isometric view of a holder, in accordance with an exemplary embodiment.
Figure 2:
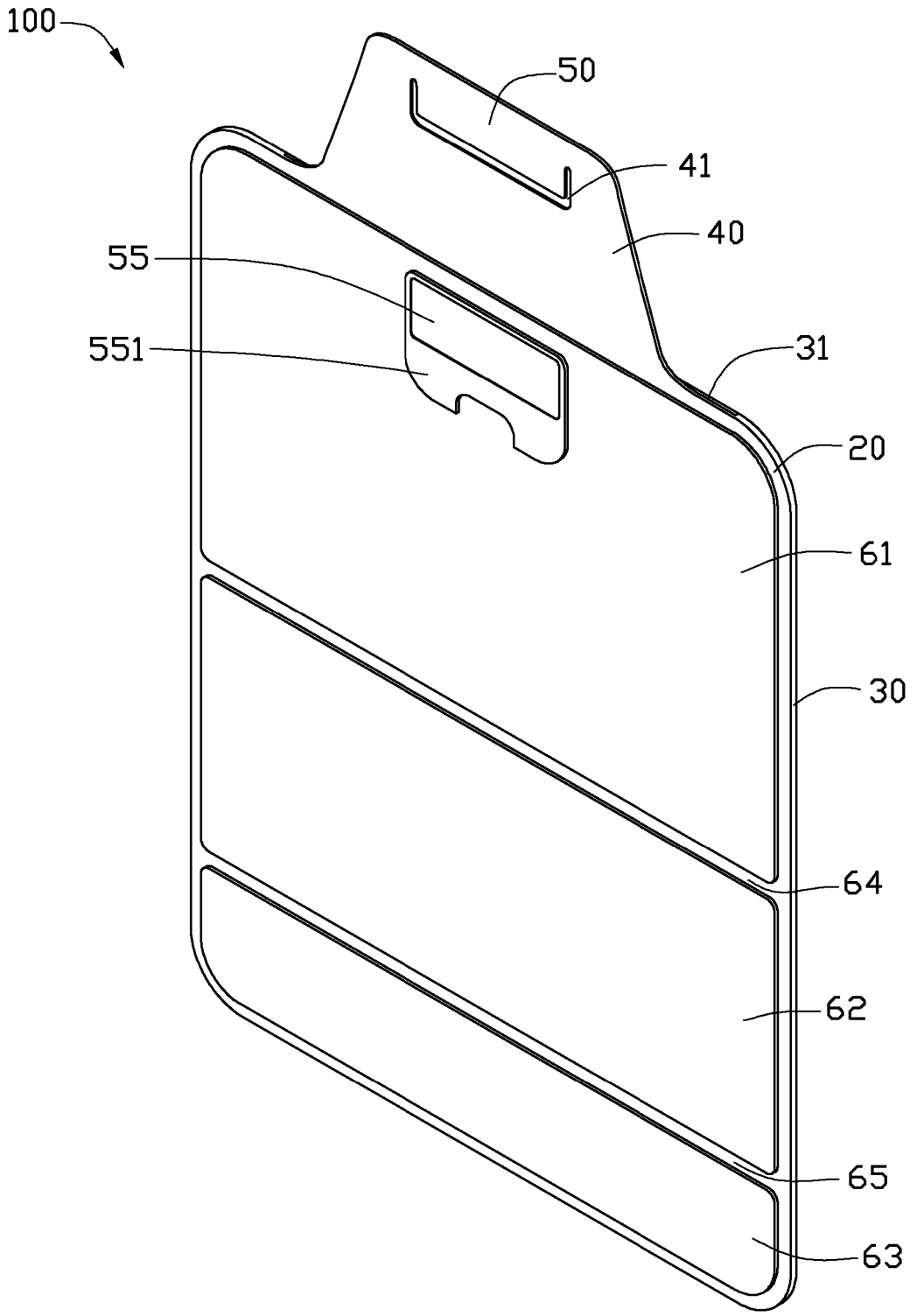
FIG. 2 is similar to FIG. 1, but shown from another aspect.
Figure 7:
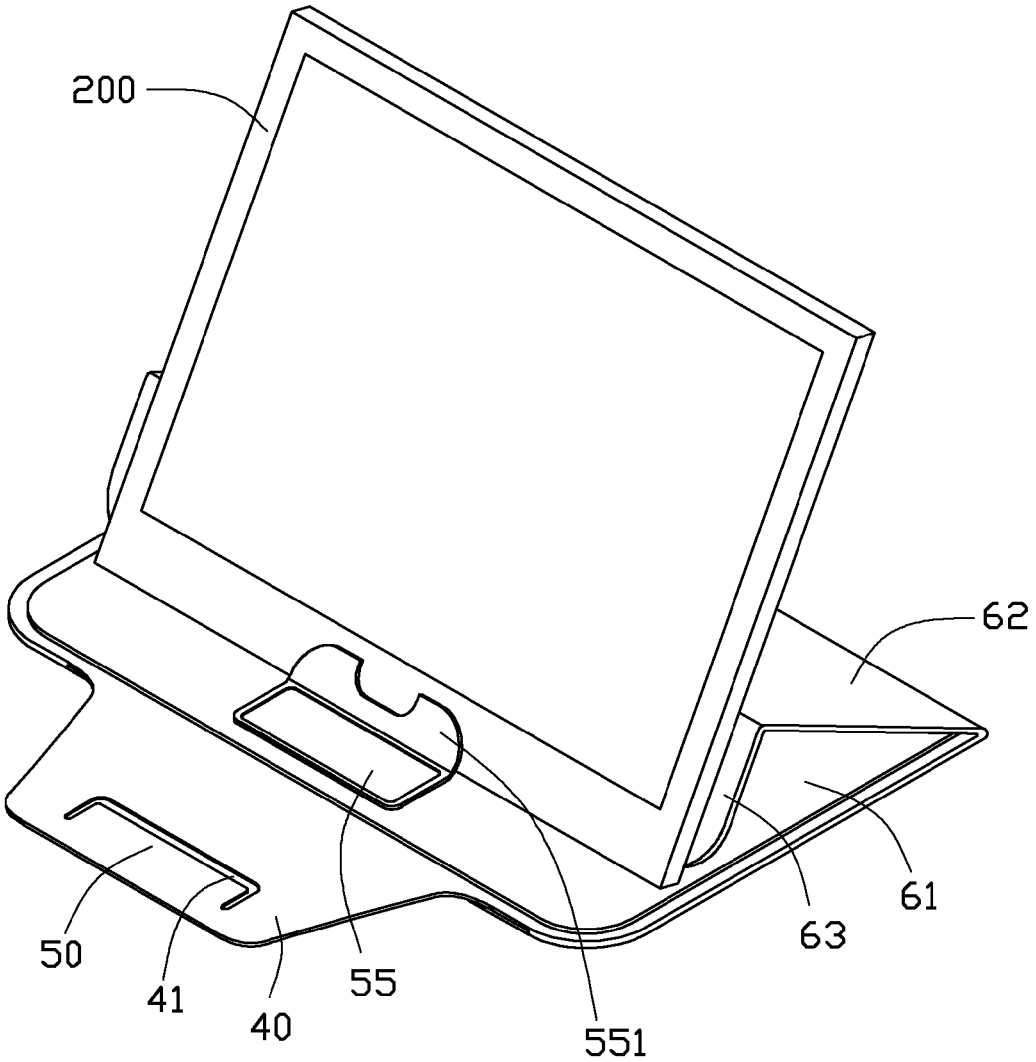
FIG. 7 shows the holder supporting the portable electronic device in a first state.

FIGS. 1-2, and 7 show an exemplary embodiment of a holder 100. The holder 100 can receive and protect a portable electronic device 200, and can also support and hold the portable electronic device 200.

Figure 3:
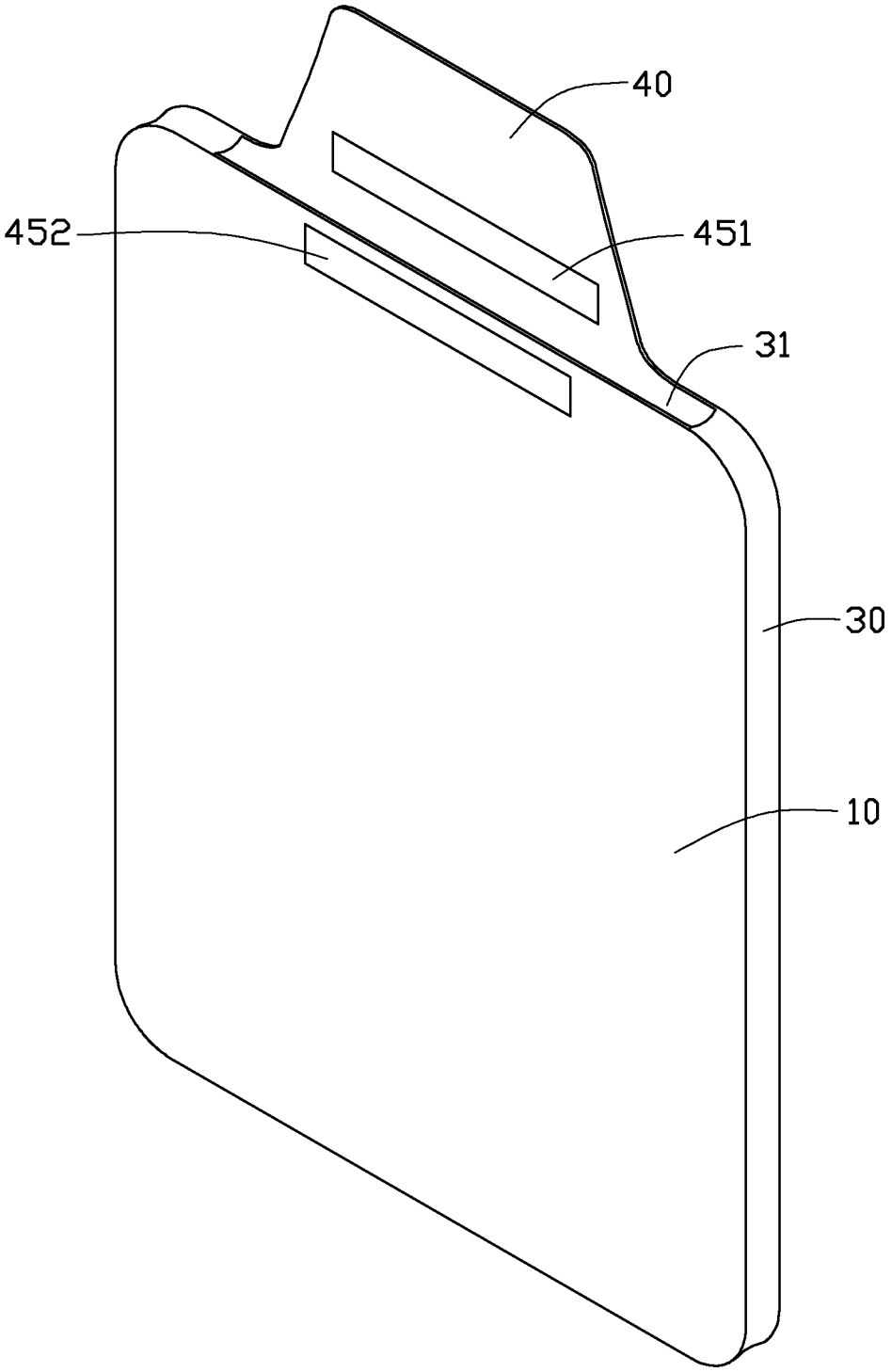
FIG. 3 is an isometric view of the holder, showing the holder for receiving a portable electronic device.

Also referring to FIGS. 2 and 3, the holder 100 includes a first outer sheet 10, a second outer sheet 20, an expandable portion 30, and a covering portion 40. A receiving space (not labeled) is defined between the second outer sheet 20 and the first outer sheet 10 and surrounded by the expandable portion 30 for receiving the portable electronic device 200. The first outer sheet 10 and the second outer sheet 20 are connected to each other along their edges by the expandable portion 30, leaving a hole 31 that allows the portable electronic device

200 to be inserted into the receiving space. The holder 100 shown herein for illustrative purpose includes the first outer sheet 10 and the expandable portion 30; however, the expandable portion 30 may be omitted and the first and second outer sheets connected to each other along their perimeters. In another example, if the holder 100 is not used for receiving the portable electronic device 200 therein, only one of the first outer sheet 10 and the second outer sheet 20 may also be used. The first outer sheet 10, the expandable portion 30, and the second outer sheet 20 are made of soft material, e.g., fiber, cotton, vinyl, thermoplastics.

The covering portion 40 is flexible and is used to cover the hole 31. The covering portion 40 may be an extension of the second outer sheet 20. The covering portion 40 shown herein is trapezoid-shaped, however, any other shapes may also be used.

Figure 6:
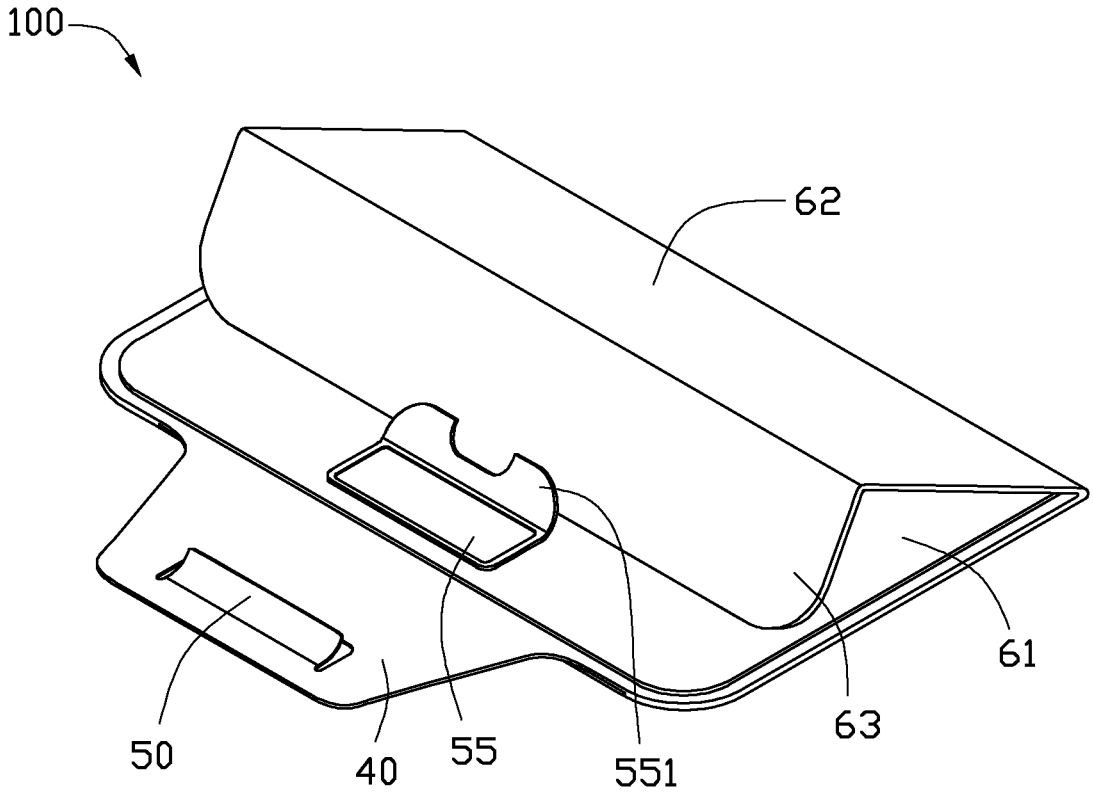
FIG. 6 is similar to FIG. 5, showing the latching portion of the holder to be bent.
Figure 8:
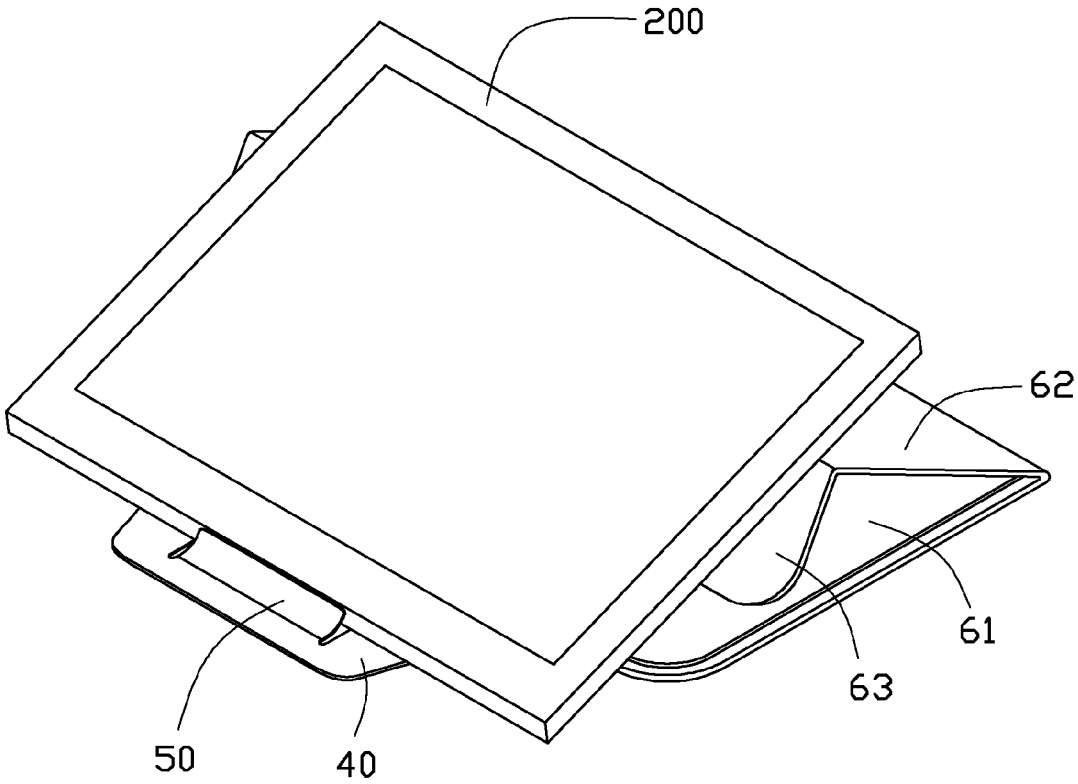
FIG. 8 shows the holder supporting the portable electronic device in a second state.

A locking member 45 is configured for retaining the covering portion 40 on the first outer sheet 10 for closing the holder 100. In the exemplary embodiment, the locking member 45 includes a first fastening tape 451 attached on one surface of the covering portion 40, and a second fastening tape 452 attached on the first outer sheet 10. The first fastening tape 451 may be adhered to the second fastening tape 452 for mounting the covering portion 40 to the first outer sheet 10. The covering portion 40 defines a slot 41 on another surface thereof. A tongue portion 50 is formed in the slot 41. One edge of the tongue portion 50 is connected to the covering portion 40. Referring to FIGS. 6 and 8, the tongue portion 50 may be bent away from the covering portion 40 to allow the portable electronic device 200 to be supported by the tongue portion 50.

Referring to FIG. 2, a base portion 61, a first supporting portion 62 and a second supporting portion 63 are formed on the second outer sheet 20. The base portion 61, the first supporting portion 62 and the second supporting portion 63 are made of rigid material.

In the exemplary embodiment, the base portion 61 is adjacent to the covering portion 40. The first supporting portion 62 is positioned between the base portion 61 and the second supporting portion 63. A first folding region 64 is positioned between the base portion 61 and the first supporting portion 62, and a second folding region 65 is positioned between the first supporting portion 62 and the second supporting portion 63. The base portion 61, the first supporting portion 62 and the second supporting portion 63 can be folded relative to each other (e.g. FIG. 4) along the first folding region 64 and the second folding region 65. However, since the first supporting portion 62 and the second supporting portion 63 are made of rigid material, the first supporting portion 62 and the second supporting portion 63 cannot be folded themselves.

The base portion 61 has a latching piece 55 formed thereon adjacent to the covering portion 40. The latching piece 55 has a bendable portion 551. The bendable portion 551 may be bent away from the base portion 61 to allow the second supporting portion 63 to be supported thereon.

Referring to FIG. 3, when the portable electronic device 200 needs to be received in the holder 100, the covering portion 40 is folded over to uncover the hole 31. The device 200 can then be inserted into the receiving space of the holder 100 via the hole 31 for storage. After that, the first fastening tape 451 is adhered to the second fastening tape 452 for mounting the covering portion 40 to the first outer sheet 10.

Figure 4:
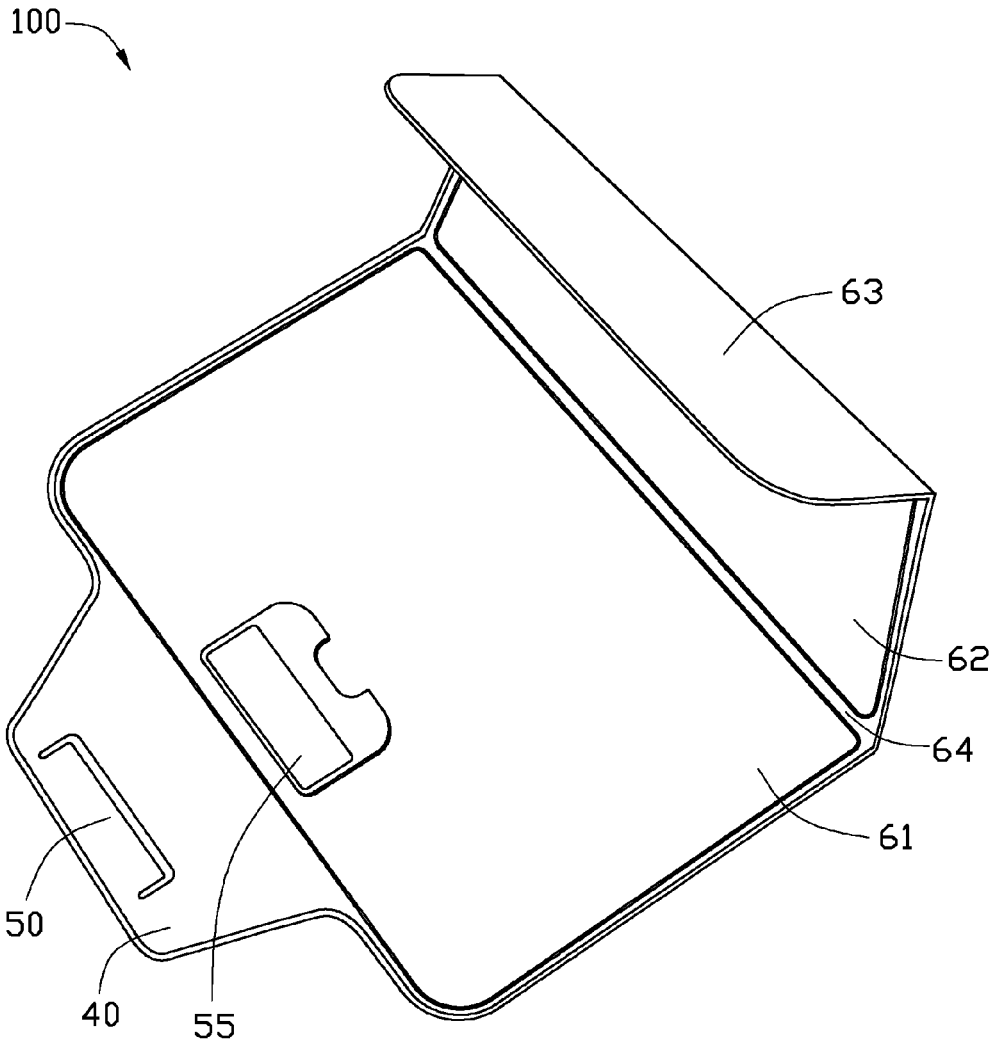
FIG. 4 is similar to FIG. 2, showing the holder in a state of being partially folded.
Figure 5:
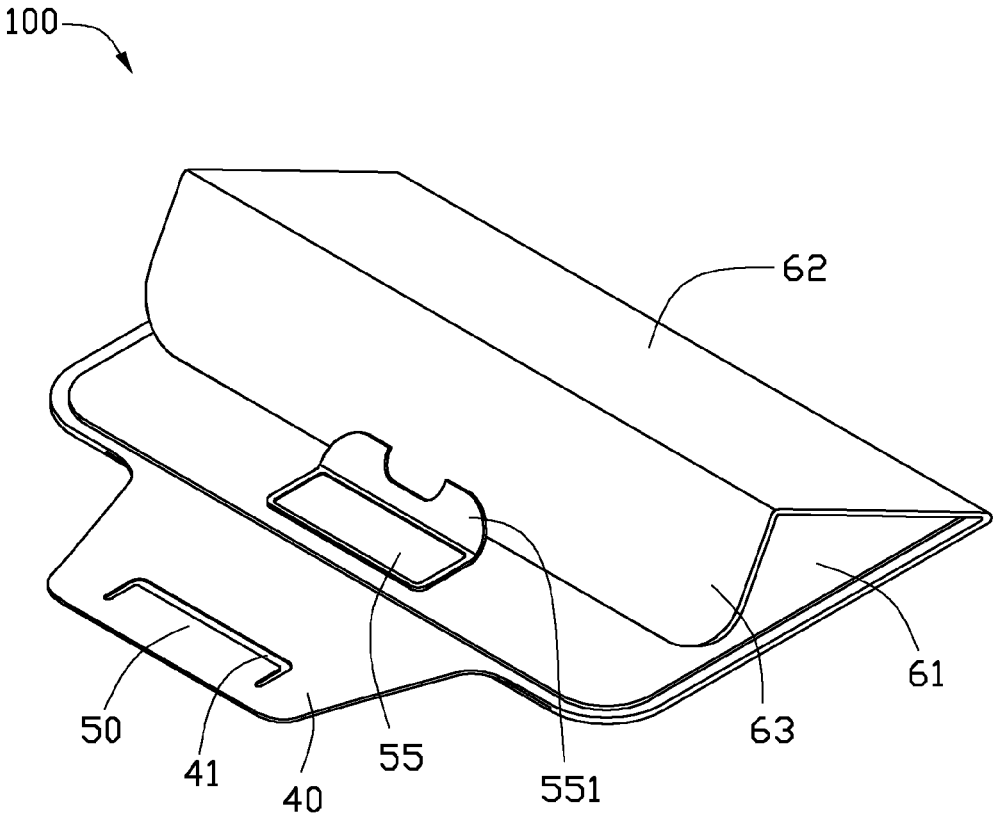
FIG. 5 is similar to FIG. 4, showing the holder folded as a support.

Also referring to FIGS. 4 and 5, to fold the holder 100 to form a support, the first supporting portion 62 and the second supporting portion 63 are folded toward the base portion 61 along the first folding region 64 and the second folding region 65 until the second supporting portion 63 stands on the base portion 63. The bendable portion 551 is folded to allow the second supporting portion 63 to be supported by the bendable portion 551. Thus, the base portion 61, the first supporting portion 62 and the second supporting portion 63 can form a three-dimensional structure that will not collapse. Also referring to FIG. 7, the portable electronic device 200 is set on the holder 100 as a support. One end of the portable electronic device 200 is supported between the foldable piece 551 and the second supporting portion 62. The portable electronic device 200 is supported by the first supporting portion 62 and the second supporting portion 63 at an angle. Thus, users can comfortably view the display of the portable electronic device 200.

Referring to FIGS. 6 and 8, if the viewed angled of the portable electronic device 200 needs to be adjusted, the tongue portion 50 can be bent around the edge along a direction far away from the covering portion 40. The portable electronic device 200 is held on the tongue portion 50. Thus, users can comfortably view the display of the portable electronic device 200 at a different angle.

It is to be understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A holder for holding and supporting a portable electronic device, comprising:

at least one sheet comprising a covering portion;

a base portion, a first supporting portion and a second supporting portion formed on the at least one sheet, the base portion, the first supporting portion and the second supporting portion parallel with each other and folded relative to each other;

a latching piece formed on the base portion, the latching piece having a bendable portion;

wherein, the first supporting portion is folded relative to the base portion, and the second supporting portion is folded relative to the first supporting portion until the second supporting portion is held by the latching piece, the base portion, the first supporting portion and the second supporting portion cooperatively form a three-dimensional structure that supports the portable electronic device at an angle relative to the at least one sheet without collapsing, the covering portion defines a slot, and a tongue portion is formed in the slot, one edge of the tongue portion is connected to the covering portion, the tongue portion is bent around the edge along a direction distal from the covering portion to allow the portable electronic device to be supported by the tongue portion.

2. The holder as claimed in claim 1, wherein the at least one sheet further comprises two sheets, wherein a hole is defined between the two sheets, the covering portion extends from one of the two sheets configured for covering the hole.

3. The holder as claimed in claim 1, wherein a first folding region is formed between the base portion and the first supporting portion, and a second folding region is formed between the first supporting portion and the second supporting portion.

4. The holder as claimed in claim 2, wherein the two sheets are made from one or more materials selected from a group consisting of fiber, cotton, vinyl, thermoplastics.

5. A foldable holder for holding and supporting a portable electronic device, comprising:

a first outer sheet and a second outer sheet connected to the first outer sheet, a receiving space being formed between the second outer sheet and the first outer sheets for receiving the portable electronic device, a hole defined to communicate with the receiving space, the hole allowing the portable electronic device to be inserted into the receiving space;

a base portion, a first supporting portion and a second supporting portion formed on the second outer sheet, the base portion, the first supporting portion and the second supporting portion parallel with each other and folded relative to each other;

a latching piece formed on the base portion, the latching piece having a bendable portion; and a covering portion;

wherein, the first supporting portion is folded relative to the base portion, and the second supporting portion is folded relative to the first supporting portion until the second supporting portion is held by the latching piece, the base portion, the first supporting portion and the second supporting portion cooperatively form a three-dimensional structure that supports the portable electronic device at an angle relative to the second outer sheet without collapsing; the covering portion defines a slot, and a tongue portion is formed in the slot, one edge of the tongue portion is connected to the covering portion, the tongue portion is bent around the edge along a direction distal from the covering portion to allow the portable electronic device to be supported by the tongue portion.

6. The foldable holder as claimed in claim 5, wherein the covering portions extends from the second outer sheet configured for covering the hole.

7. The foldable holder as claimed in claim 5, wherein a first folding region is formed between the base portion and the first supporting portion, a second folding region is formed between the first supporting portion and the second supporting portion.

8. The holder as claimed in claim 1, further comprising a locking member configured for retaining the covering portion on the at least one sheet for closing the holder.

9. The holder as claimed in claim 8, wherein the locking member comprises a first fastening tape attached on one surface of the covering portion, and a second fastening tape attached on the at least one sheet; the first fastening tape is adhered to the second fastening tape for mounting the covering portion to the at least one sheet.

10. The foldable holder as claimed in claim 5, further comprising a locking member configured for retaining the covering portion on the first outer sheet for closing the holder.

11. The foldable holder as claimed in claim 10, wherein the locking member comprises a first fastening tape attached on one surface of the covering portion, and a second fastening tape attached on the first outer sheet; the first fastening tape is adhered to the second fastening tape for mounting the covering portion to the first outer sheet.

* * * * *